US006382058B1

(12) United States Patent
Owoc

(10) Patent No.: US 6,382,058 B1
(45) Date of Patent: May 7, 2002

(54) MULTI-JOINTED WRENCH HANDLE

(76) Inventor: Greg J. Owoc, 106 Galphin Dr., Greenville, SC (US) 29604

( * ) Notice: Subject to any disclaimer, the term of this patent is extended or adjusted under 35 U.S.C. 154(b) by 0 days.

(21) Appl. No.: 09/333,017

(22) Filed: Jun. 15, 1999

(51) Int. Cl.[7] ..... B25B 23/16
(52) U.S. Cl. ..... 81/177.9; 81/177.8
(58) Field of Search ..... 81/177.9, 177.8, 81/177.7, 124.5, 440

(56) References Cited

U.S. PATENT DOCUMENTS 1,431,389 A * 10/1922 Frisz ..... 81/177.7
2,028,561 A * 1/1936 Pilger ..... 81/177.9
3,186,265 A * 6/1965 Wenturine et al. ..... 81/177.9
3,270,597 A * 9/1966 Neff et al. ..... 81/177.9
3,383,962 A * 5/1968 Harris ..... 81/177.9
4,334,445 A * 6/1982 Timewell ..... 81/177 PP
4,461,192 A * 7/1984 Suligoy et al. ..... 81/177.8
4,463,632 A * 8/1984 Parke ..... 81/177.9
4,938,107 A * 7/1990 Nickipuck ..... 81/177.85
5,813,296 A * 9/1998 Hoff et al. ..... 81/177.85
5,904,077 A * 5/1999 Wright et al. ..... 81/177.9
5,927,162 A * 7/1999 Huang ..... 81/177.8
5,943,925 A * 8/1999 Huang ..... 81/177.2
6,098,506 A * 8/2000 Clegg ..... 81/177.7
6,167,787 B1 * 1/2001 Jarvis ..... 81/177.2
6,186,033 B1 * 2/2001 Faro, Sr. ..... 81/177.7

* cited by examiner

*Primary Examiner*—James G. Smith
*Assistant Examiner*—Hadi Shakeri
(74) *Attorney, Agent, or Firm*—Flint & Kim, P.A.

(57) ABSTRACT

Standard flex-head wrenches and other standard wrenches having a head or fastener end-working portion are improved by adding a second and even third joint within the handle portion of the wrenches. The additional joints may comprise the standard ball bearing detent and mated groove pinion portion alone in structure or in conjunction with a locking sleeve, which aids in biasing the handle in any number of predetermined positions.

6 Claims, 4 Drawing Sheets

MULTI-JOINTED WRENCH HANDLE

BACKGROUND

1. Field of the Invention

The present invention discloses an improvement of standard ratchet wrenches that have one joint or hinge mechanism at the head portion of the wrench. Though primarily used in ratchet wrenches, any number of different wrenches may utilize the structure. This original single hinge particular wrench embodiment is well known in ratchet wrench art and provides a useful movement of the whole handle to get around various obstructions encountered by a wrench user, while ratcheting in a restricted work environment.

2. Description of Prior Art

One patented ratchet that attempts to enhance handle movement is found in U.S. Pat. No. 5,630,342, wherein various joints are disclosed that are integral to the wrench pawl or rotating gear. This design allows more 3-dimensional movement to the handle in tight ratcheting spaces, but still has limitations, since the handle cannot mechanically comprise another joint without becoming difficult to gain a fixed torque position.

Several hinged wrenches have been known in the prior art for many years that achieve more flexibility in the handle. A unique flexible head socket wrench is found in U.S. Pat. No. 5,280,740, wherein a standard, hinge head ratchet comprising a single hinge is improved by adding a "sleeved" handle portion, whereby a user may "twist" the handle, and turn in and out fasteners.

Another hinge head handle is found in U.S. Pat. No. 5,517,884, whereby a single hinge is fixed near the handle portion furthest from the head of the wrench. In all embodiments, the handle end portion is a sleeve itself and rotates on a second handle shaft "spindle." It is to be clearly observed that the above wrench has a bore in the handle wherein a spring is inserted to simply "pull" the handle back to a "undetented" and "straight" handle position. The handle, since it possesses mating threaded ends, is then "screwed back together into one, straight fixed position—not only having only one joint, and, as the previous wrenches, is far different from the application, and multi-joint structure and "detenting" nature of the present invention. The above invention, though useful as a crank, has torque limitations, because of the sleeve-shaft feature.

A third ratchet wrench that includes a hinge is found in U.S. Pat. No. 4,262,561, wherein the single hinge is located on a crank portion on the end of the handle. This wrench has the added feature of a bevel gear drive system, in addition to the fixed pawl mechanism. It enables the wrench user to wind the crank hinge handle without moving the whole entire ratchet handle and is useful tool, though it does not comprise the handle flexibility that the present invention is attempting to achieve.

From the above discussed prior art, it is evident that attempts, many successful, have been made to improve the standard ratchet wrench further by adding features and elements for greater tool use and accessibility for difficult to reach fasteners. It is an object of the present invention also to increase the flexibility of presently used wrenches, especially standard "hinge-headed" ratchet wrenches, but also various adjustable wrenches in present use, as well. This is achieved by including more than one hinge joint within the handle body, thereby increasing moveability, compactness and a greater overall usefulness, since the handle can be fixed into any number of predetermined positions. It is another object of this invention to have this additional handle joint or joints have a solid-fixed locking or detent, semi-fixed locking capacity.

SUMMARY

The present invention is summarize as follows: A wrench handle, preferably of a standard ratchet wrench (but also a variety of different adjustable wrenches), as those in present use, that includes at least two hinges. One hinge is located at the known useful position of the upper neck portion of the wrench body. In the present invention, however, at least one additional joint is included at the lower neck portion or near the gripping portion of the handle.

It is preferred to have this new joint or joints, hereinafter referred to as the second joint, to include a locking mechanism, preferably in either the structure of the standard mated groove and ball bearing detent structure or in combination with, or in the stead of the structure of a biasing ring. The biasing ring may be made "fixed-position" locking or simply "semi-fixed locking" upon the handle. The biasing ring may include additional spring-loaded capacity and, as well, may be used on the traditional neck portion also, for the same locking or biasing effect.

To anyone skilled in the art, it can be seen that many combinations of handle positions may be derived from such a structure, by combining more than one joint in a fixed or semi-fixed position to the standard wrench handles in present use to construct the unique structure of what may be herein referred to as a "double-hinge" wrench handle.

The above summary is general and serves as an overview of the invention. Further features and modifications besides those summarized above will be described in the following description. It should be obvious to one skilled in the present art to see possible general modifications that may be substituted for those employed to achieve the purposes of the present invention, while not departing from the spirit or scope of the present invention.

BRIEF DESCRIPTION OF THE DRAWINGS

FIG. 5 comprises three optional wrench heads that may utilize the multi-hinge handle.

DETAILED DESCRIPTION OF THE PREFERRED EMBODIMENTS

Figure 1:
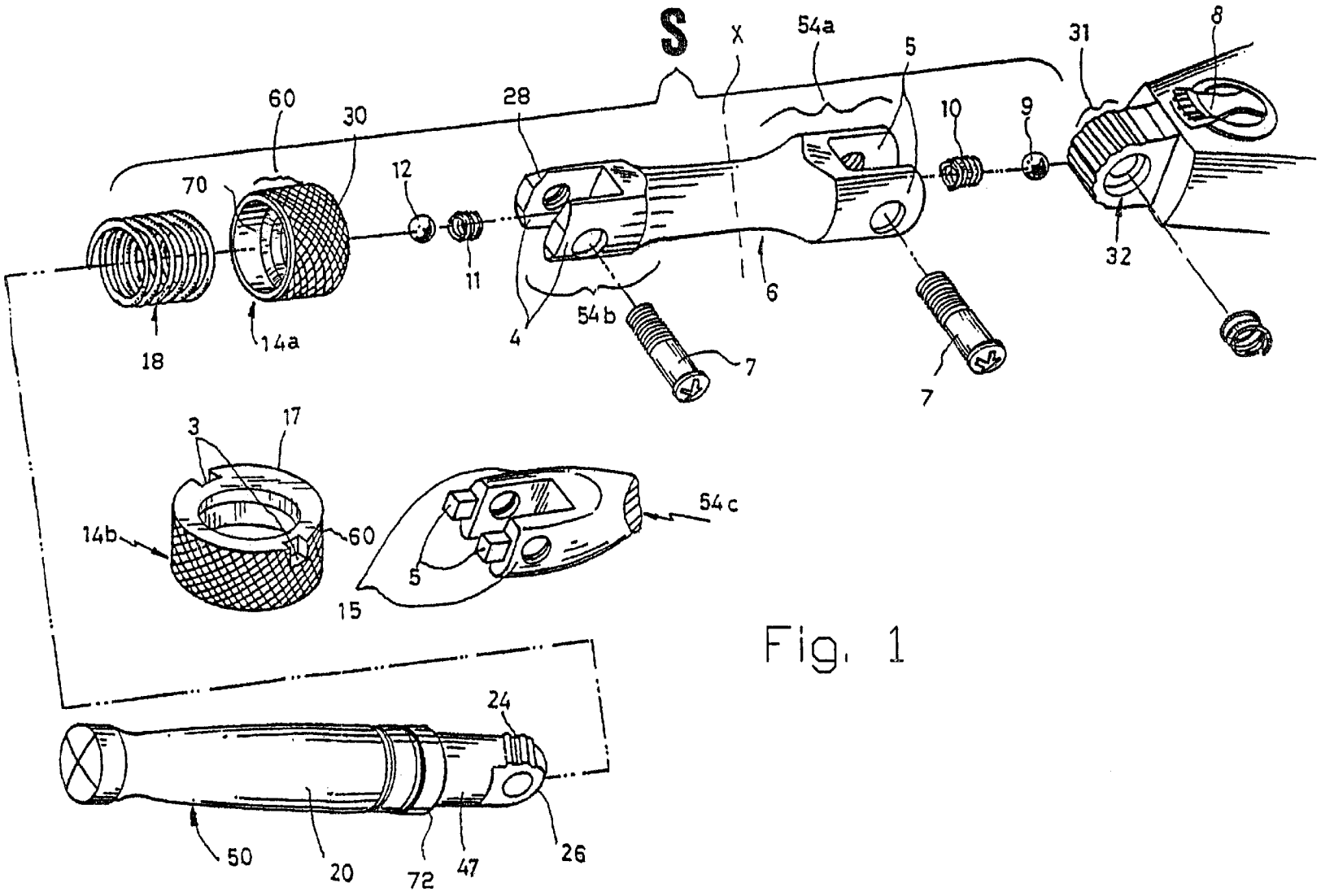
FIG. 1 is a perspective, comprehensive, exploded drawing of the multi-hinge wrench handle, comprising two joints, including optional locking ring, and optional ratchet head.

In describing the preferred embodiments illustrated in the drawings and summarized above, specific terminology will be resorted to for sake of clarity. However, it is not intended to be limited to the specific terms so selected and it is to be understood that each specific term includes all technical equivalents which operate in a similar manner to accomplish a similar purpose.

Figure 2:
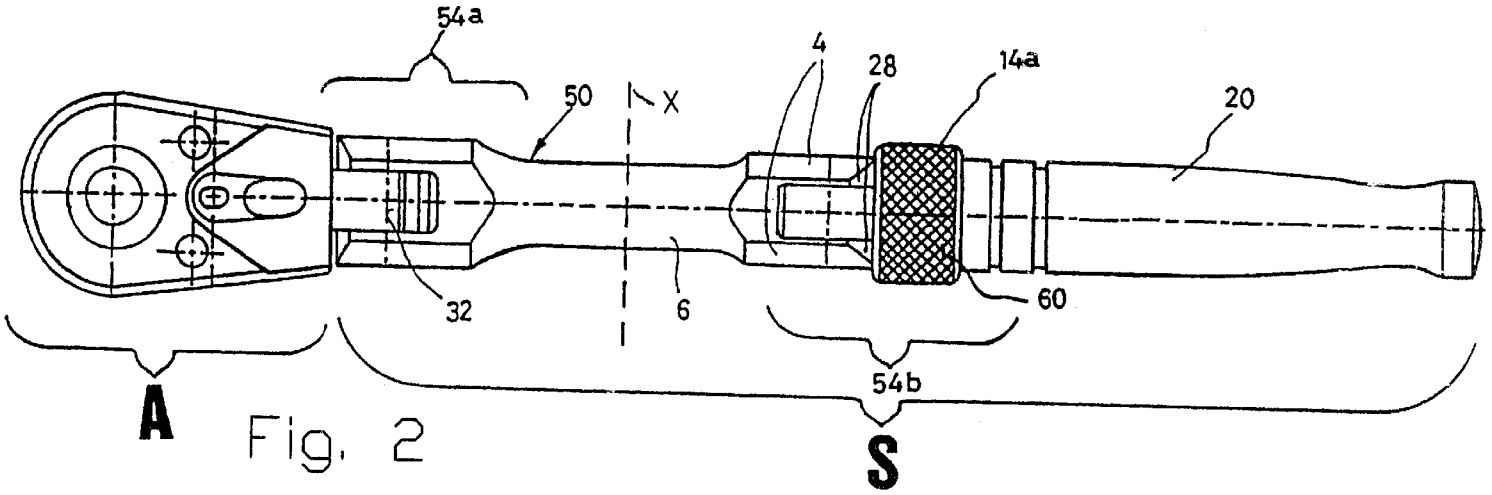
FIG. 2 is an assembled, top view of the multi-hinge handle, with optional ratchet wrench head.
Figure 3:
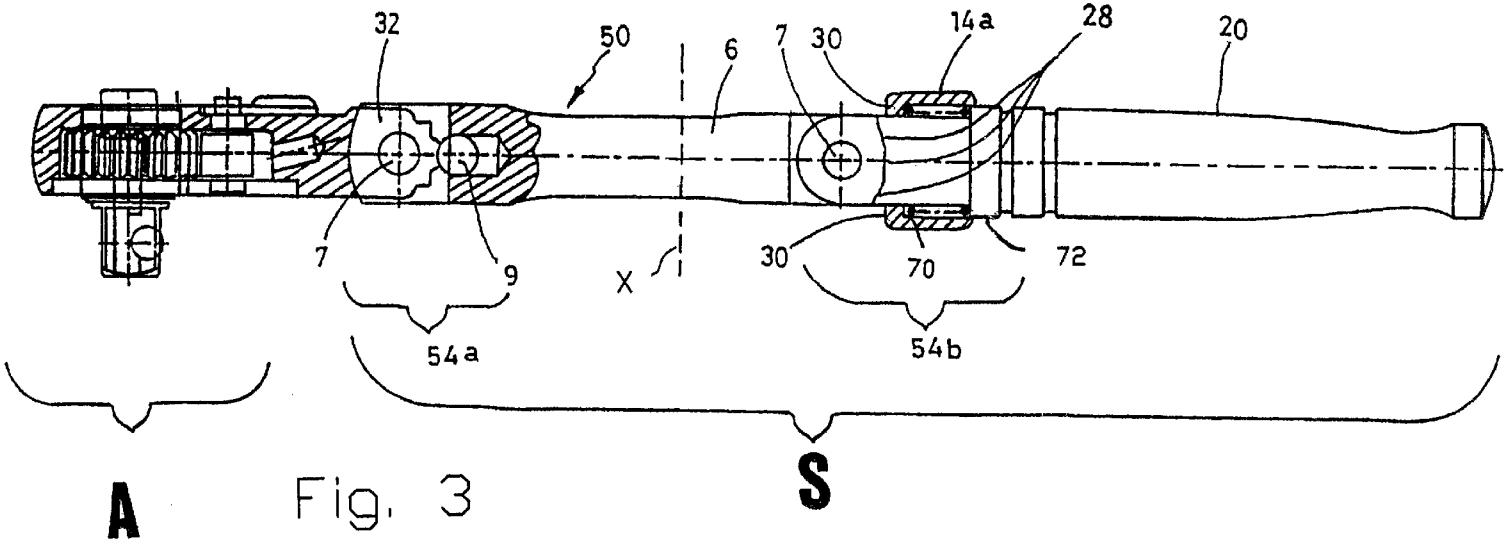
FIG. 3 is a side, cutaway view of the multi-hinge handle, with optional ratchet wrench head.
Figure 4A:
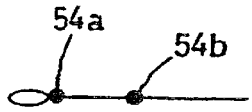
FIGS. 4*a*, 4*b*, 4*c*, 4*d* a series of diagramatic views showing the various positions of the wrench of the inventions. No objections were made to the specification, nor to the insert to the bottom of page 4.
Figure 4B:
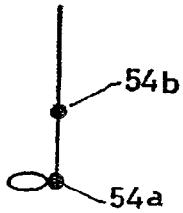
Figure 4C:
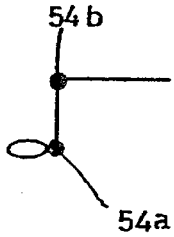
Figure 4D:
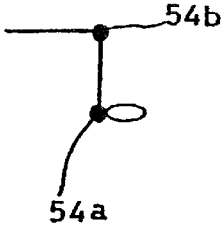
Figure 4F:
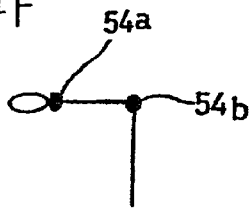
Figure 4G:
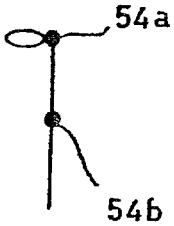
Figure 4E:
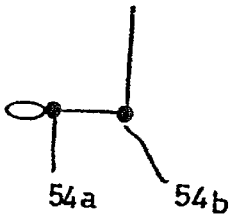
Figure 4H:
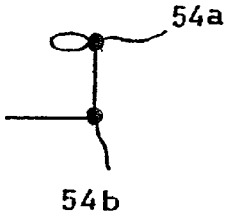
Figure 4I:
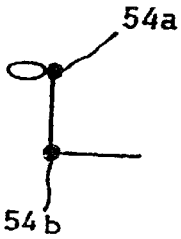
Figure 5B:
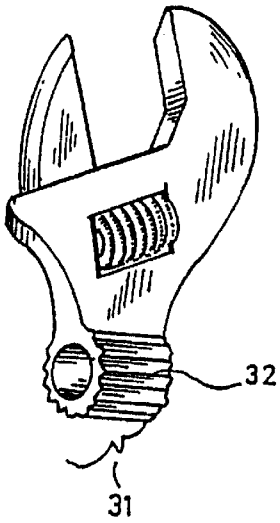
FIG. 5*b*. illustrates the standard adjustable wrench head.
Figure 5D:
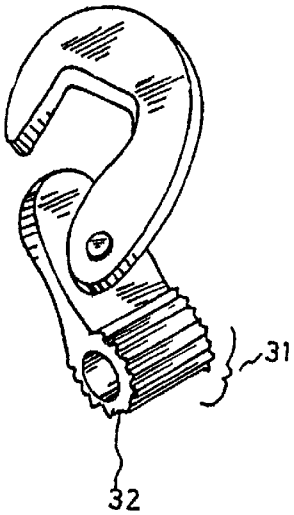
FIG. 5*d*. shows the cam-slipping adjustable wrench head, known in the art for over 25 years.
Figure 5C:
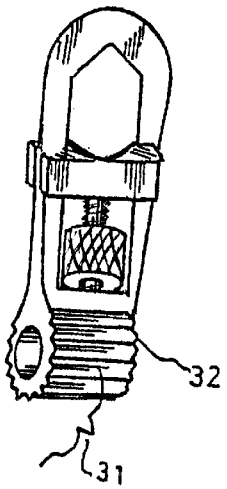
FIG. 5*c*. illustrates the newer adjustable clawing type wrench head.

With reference to the basic invention in FIG. 1., and also in both FIG. 2. and FIG. 3, note wrench 50, with wrench multi-joint handle portion "S", a wrench handle means hereinafter referred to also as comprising ratchet wrench head "A," comprising pawl switch 8. Noting FIG. 5, same said MHP could comprise at least three other wrench heads in use. Said MHP could have hinge head-portion 32 that would support, in FIG. 5B the standard, adjustable wrench head depicted therein as easily as FIG. 5D and the cam-slipping adjustable wrench head illustrated, or as well, the claw-type adjustable wrench head shown in FIG. 5C. Said MHP is preferred to have only two joints, as depicted in the Figures above, however, three or more joints are possible and potentially beneficial on one wrench handle.

Said hinge head portion 32 connects to a first hinge means, also know as head yoke 54*a*, using one of threaded rivets 7, that nests in first yoke arms 5 by encasing and continually biasing ball bearing 9 and spring 10 against hinge head ratchet teeth 31. These serve to enable the wrench user to "detent" the wrench head in various angular positions so that wrench user may gain access to hard to reach fasteners and this mechanical joint arrangement is known in prior art. However, intermediate handle portion, also known as a double yoke piece 6 comprises at opposite end the novel addition of a second hinge means handle yoke 54*b* which hingably joins handle end 20 through handle hinge portion 22 through said rivets 7, nesting in second yoke arms 4, encasing and continually biasing ball bearing 12 and spring 11 inside a bore (not shown) in said double yoke piece 6, against handle hinge teeth 24 of said handle hinge portion 22. This enables the said handle end 20 to be oscillated on said handle yoke 54*b* with the same range of freedom that said wrench head "A" or any of the said wrench head figures shown in FIG. 5 possess, on said hinge head portion 32.

It is easily understood by one skilled in the art that the hinge and detenting action is identical on both ends of the said double yoke piece 6, as described to this point. And that it is highly novel and useful to include this said additional handle yoke 54*b* at or near the location depicted in the above said Figures, since compactness and versatility are enhanced greatly, due to the increased "flexibility" of the said MHP. FIG. 4 depicts at least nine major wrench handle positions of the said MHP in FIGS. 4*a* through FIGS. 4I, but many other positions are possible within the internal ranges of these double-jointed "right-angle" fixed position configurations, that are also useful angles in which to ratchet a fastener.

Two additional features of the said MHP are described which involve the use of an optional, additional biasing or locking component, detent ring 14*a*, (preferably with knurls 60 and with internal compression ring spring 18), which comprises biasing surface 30 that biases against detent surfaces 28 on said second yoke arms 4, as said ring 14*a* rotatably nests on handle end shaft portion 47. The angles of said handle hinge teeth match the said detent surfaces 28 to add the optional double detenting or combined detenting force of both said ring, though either detenting means described could accomplish the forces necessary to fix said MHP in any desired fixed position within the predetermined hinge range.

A locking feature, in addition to the biasing capability described in said detent ring 14*a*, is included in locking-detent ring 14*b*, which comprises indents 3 that mate with yoke prongs 5 that are shown as integral to alternate yoke portion 54*c*. As said ring 14*b* is twisted and pulled back out of a locked (mated-said prongs 5 and said indents 3) position, toward the MHP end, yoke prong surfaces 15 "sprag" on the surfaces 17 of said ring 14*b* until it "click-locks" again back into a straight handle position, after approximately 180 degrees of ring spin. Other angles may by chosen in which to lock the wrench handle by simply changing the angle of the said yoke prongs 5 and their respective mating said ring indents 3. As well, these said indents 3 can have a variety of shapes, such as v-shape or u-shape, that can serve to adequately supply locking capability to the mechanism purposes described.

Note also that at section "X," which is approximately the midpoint of said double yoke piece 6, that a third joint may be included to furnish the structure with even more flexibility, though two joints should be sufficient for most wrench user applications.

It is to be understood that the form of the invention herewith shown and described above is to be taken as preferred embodiments. Various changes may be made in the shape, size and arrangements of parts, for example: other equivalent elements may be substituted for those illustrated and described herein, parts and elements may be reversed and certain features of the invention may be utilized independently of the use of other features, all without departing from the spirit or scope of the invention, as defined in the subjoining claims.

By the grace of god, I claim:

1. A wrench having a handle capable of assuming multiple work positions comprising:

a wrench head having a stud at one end;

a handle, said handle, including a handle end having a stud at one end and an intermediate portion having first and second yokes at respective ends thereof, said first yoke pivotally engaging with said wrench head stud and said second yoke pivotally engaging with said handle end stud;

each said stud including transverse teeth and said respective ends each carrying a spring urged ball adapted to be releasably engaged with respective of said teeth to resiliently lock said handle end and said wrench head in selected positions relative to said intermediate portion, said teeth, spring and ball forming a first locking assembly;

a plurality of paired detent surfaces arranged over end portions of said second yoke;

said handle end adjacent said one end having a raised preferial shoulder;

a longitudinally and rotably movable detent ring, having an inner collar adjacent a first end, positioned over said one end of said handle end and a second end of said detent ring positioned over said shoulder forming an enclosed housing; and a compression spring carried about said one end within said housing engaging said collar and said shoulder urging said detent ring away from said shoulder and into engagement with one of said paired detent surfaces said compression spring, said detent ring and said detent surfaces forming a second locking assembly wherein;

said wrench head may be positioned into and resiliently maintained in one of a multiple of available positions relative to said intermediate portion by said first locking assembly and said handle end may be positioned into and resiliently maintained in one of a multiple of selected positions relative to said intermediate portion by said first locking assembly and said second looking assembly, resiliently maintaining said handle end and said wrench head in selected positions relative to said intermediate portion.

2. A wrench having a handle capable of assuming multiple work positions comprising:

a wrench head having a stud at one end;

a handle including a handle end having a stud at one end and an intermediate portion having first and second yokes at respective ends thereof said first yoke pivotally engaging with said wrench head stud and said second yoke pivotally engaging with said handle end stud;

each said stud including transverse teeth and said respective ends each carrying a spring urged ball adapted to be releasably engaged with respective of said teeth to resiliently lock said handle end, and said wrench head in selected positions relative to said intermediate portion, said teeth, ball and spring forming a first locking assembly;

prongs extending from at least one of said first and second yokes;

said handle end having a preferial raised shoulder;

a detent ring having an inner collar at a first end positioned over said one end of said handle end for longitudinal movement relative to said handle end, said detent ring having indents formed in said first end;

a compression spring carried about said one end of said handle end and in engagement with said shoulder and said collar, said compression spring urging said collar toward said yoke ends and said prongs said compression spring, said collar and said yoke ends forming a second locking assembly wherein;

said wrench head may be positioned into and resiliently maintained in one of a multiple of positions relative to said intermediate portion by said first locking assembly and said handle end may be positioned into and resiliently maintained in one of a multiple of positions relative to said intermediate portion by said first locking assembly and said handle end may be positioned in one preselected position relative to said intermediate portion and positively locked in position by said second locking assembly.

3. The wrench of claim 2 wherein said handle end and said intermediate portion extend along a common axis in said positive locked position.

4. The wrench of claim 2 wherein an Inner surface of said detent ring extends about a peripheral surface of said shoulder forming a housing between said shoulder and said collar.

5. The wrench of claim 4 wherein said compression spring is positioned in said housing.

6. The wrench according to claim 2 wherein said second locking assembly assumes said positive locked position with said prongs engaged in said indents.

* * * * *